US005452267A

United States Patent [19]

Spevak

[11] Patent Number: 5,452,267

[45] Date of Patent: Sep. 19, 1995

[54] MIDRANGE ULTRASONIC TRANSDUCER

[75] Inventor: Lev Spevak, Highland Park, Ill.

[73] Assignee: Magnetrol International, Inc., Downers Grove, Ill.

[21] Appl. No.: 187,648

[22] Filed: Jan. 27, 1994

[51] Int. Cl.[6] ..... H04R 17/00

[52] U.S. Cl. ..... 367/163; 367/174; 310/328; 310/334

[58] Field of Search ..... 367/163, 174, 908, 157; 310/328, 334, 336; 340/621

[56] References Cited

U.S. PATENT DOCUMENTS

| | | | |
|---|---|---|---|
| 1,693,727 | 12/1928 | Pape | 367/174 |
| 3,578,104 | 5/1971 | Sotome | 181/32 |
| 3,584,160 | 6/1971 | Janssen | 179/110 C |
| 3,674,945 | 7/1972 | Hands | 310/8.3 |
| 3,777,192 | 12/1973 | Barrow | 367/174 |
| 3,804,329 | 4/1974 | Martner | 239/4 |
| 3,849,679 | 11/1974 | Massa | 310/324 |
| 3,890,513 | 6/1975 | Barleen et al. | 310/9.1 |
| 3,891,869 | 6/1975 | Scarpa | 310/26 |
| 4,078,160 | 3/1978 | Bost | 310/331 |
| 4,190,784 | 2/1980 | Massa | 310/324 |
| 4,333,028 | 6/1982 | Panton | 310/326 |
| 4,594,584 | 6/1986 | Pfeiffer et al. | 310/323 |
| 4,768,615 | 9/1988 | Steinebrunner et al. | 181/157 |
| 5,218,575 | 6/1993 | Cherek | 367/140 |

FOREIGN PATENT DOCUMENTS 1546591 11/1968 France .

*Primary Examiner*—J. Woodrow Eldred

*Attorney, Agent, or Firm*—Wood, Phillips, VanSanten, Clark & Mortimer

[57] ABSTRACT

An acoustic transducer has an electrically energized crystal in contact with a flexible plate. The crystal drives the plate in a flexural mode. Particularly, the plate is oscillated so that different circular areas of the plate, referred to as nodes, do not vibrate. The nodes separate adjacent annular anti-node areas referred to as positive anti-nodes and negative anti-nodes which oscillate oppositely. An impedance matching material of uniform thickness is disposed between the plate and the surrounding medium to improve efficiency. To avoid cancellation of waves, concentric plastic layer rings are disposed between the impedance matching layer and the oscillating disk. The plastic rings act as a barrier to negative anti-nodes, thus eliminating cancellation between waves from the positive and negative anti-nodes.

18 Claims, 3 Drawing Sheets

MIDRANGE ULTRASONIC TRANSDUCER

FIELD OF THE INVENTION

This invention relates to a level measuring instrument and, more particularly, to an improved ultrasonic transducer.

BACKGROUND OF THE INVENTION

Level measuring instruments using various technology are known. Certain applications necessitate the use of a level measuring instrument which does not come into contact with the material the level of which is being measured. One such device is an ultrasonic measuring system in which an ultrasonic transmitter is vibrated to generate an acoustic signal directed at the material. A return signal is received by an ultrasonic receiver. In one known form, an acoustic transducer is used in which common components are used for both the transmitter and receiver operating in a pulse echo mode. A crystal is pulsed to generate an acoustic sound wave. The crystal is then de-energized and the acoustic sound wave echoes off the material and is received by the transducer, with the time difference between transmission and return of the echo representing distance, and thus level.

Numerous problems exist with respect to the design of such ultrasonic transducers. For example, an optimum impedance matching material must be used to efficiently transmit sound waves at ultrasonic frequencies from a piezoelectric crystal into air.

Martner, U.S. Pat. No. 3,804,329, discloses an ultrasonic generator for use as an atomizer of liquids. A large diameter disk is clamped to a small annular crystal. This disk vibrates in what is known as the flexural mode. When all parts are vibrating in phase the disk vibrates in a mode shape having node and anti-node areas located in concentric rings radiating from the center of the disk. Particularly, the disk is oscillated so that different circular areas of the plate, referred to as nodes, do not vibrate. The nodes separate adjacent positive anti-nodes and negative anti-nodes, which oscillate oppositely. However, the plate is of a high acoustic impedance material, while the environment in which it is typically used is of low acoustic impedance which results in poor transmission of energy from the plate to the medium. Moreover, after traveling a short distance, the wave fronts from the positive and negative anti-nodes cancel each other since they are 180° out of phase.

Various solutions have been proposed for solving the problems evident with the Martner ultrasonic generator when used as a level measuring device. Panton, U.S. Pat. No. 4,333,028, discloses the use of a flexural mode transducer using impedance matching and phase shifting rings to increase sensitivity. The tings are of different thicknesses. The transducer is more expensive to construct and may have less accurate directability. Moreover, when exposed in a hostile environment the non-uniform matching surface can pose its own problems. For example, in a dusty environment the dust will not cover the transducer uniformly because it can collect in the grooves formed by the rings. A nonuniform layer of dust will distort the beam more drastically than is desired. The different thicknesses of the rings at the positive and negative anti-node are used to shift the phase of the signal from the negative anti-node areas by 180 degrees so that it will add to that from the positive anti-node. However, depending on the properties of the acoustic foam material used, which can change with humidity, temperature, etc., the efficiency of the transducer may decrease by making the phase shift different from 180 degrees.

Steinbrunner et al., U.S. Pat. No. 4,768,615, discloses an acoustic transducer using a perforated plate over the vibrating disk to provide a barrier to the sound waves in the negative anti-nodes. As a result, all wave fronts transmitted into the air are in phase to eliminate cancellation. However, the lack of an impedance matching material results in less than optimum sensitivity of the resulting transducer system.

The disclosed invention is directed to overcoming one or more of the problems discussed above in a novel and simple manner.

SUMMARY OF THE INVENTION

In accordance with the invention, an acoustic transducer is provided which is operable over relatively long distances.

Broadly, there is disclosed an acoustic transducer comprising an electrical vibration transducer and a flexible oscillating assembly operatively connected to the vibration transducer for radiating sound waves between surrounding media and the vibration transducer. The assembly comprises a flexible plate to define a plurality of concentric, radially spaced annular anti-node areas, such that adjacent anti-node areas vibrate oppositely, a layer of adhesive on an outer surface of said plate, a plurality of concentric, annular barrier rings secured to said plate at alternate anti-node areas to define exposed areas therebetween, and a layer of acoustic impedance matching material overlying said plate outwardly of said barrier rings and secured to said plate at said exposed areas, so that said barrier rings prevent cancellation of acoustic sound waves and said impedance matching material increases sensitivity of said acoustic transducer.

It is a feature of the invention that the vibration transducer preferably comprises a piezoelectric transducer.

It is another feature of the invention that the oscillating assembly is secured to the vibration transducer using a threaded fastener.

It is a further feature of the invention that the layer of impedance matching material is of uniform thickness.

It is an additional feature of the invention that the barrier rings comprise plastic rings.

It is another feature of the invention that the barrier rings comprise polyester film rings.

In accordance with another aspect of the invention there is disclosed an acoustic transducer comprising an electrical vibration transducer and a flexible, circular oscillating assembly operatively connected to the vibration transducer about an axial center point thereof for radiating sound waves between surrounding media and the vibration transducer. The assembly comprises a flexible, circular plate to define a plurality of concentric, radially spaced anti-node areas, such that adjacent anti-node areas vibrate oppositely, a layer of adhesive on an outer surface of the plate, a plurality of concentric, annular, successively larger barrier rings secured to the plate at alternate anti-nodes to define exposed anti-nodes therebetween, and a layer of acoustic impedance matching material overlying the plate outwardly of the barrier rings and secured to the plate at the exposed anti-node areas, so that the barrier rings prevent cancellation of acoustic waves and the impedance matching material increases sensitivity of the acoustic transducer.

Further features and advantages of the invention will be readily apparent from the specification and from the drawing.

DETAILED DESCRIPTION OF THE INVENTION

Figure 1:
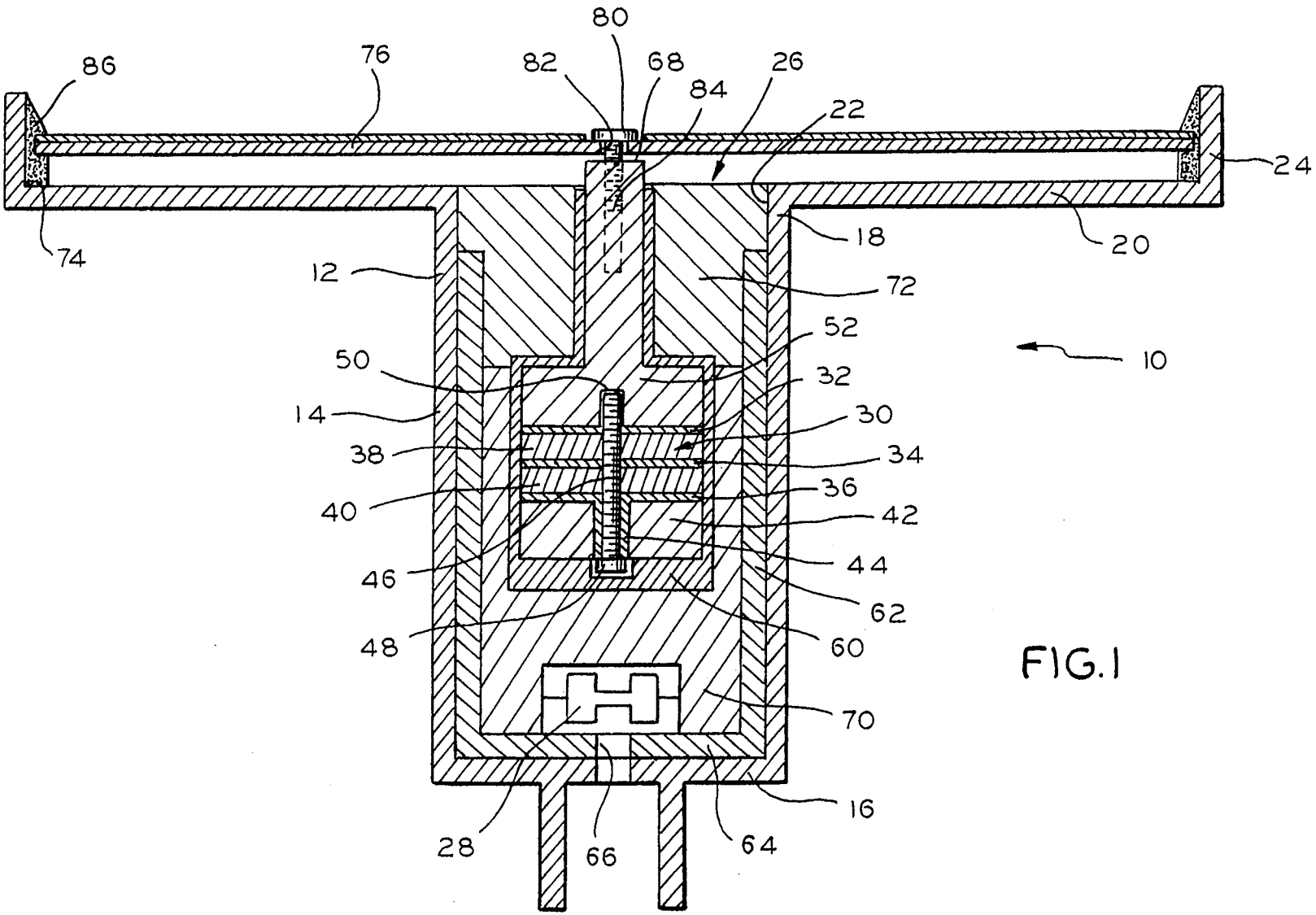
FIG. 1 is a schematic sectional view of an acoustic transducer according to the invention.

With reference to FIG. 1, an acoustic transducer 10 according to the invention is provided for operation in mid-range level sensing applications and having improved sensitivity. Particularly, the transducer 10 is operable over distances as great as sixty-five feet.

The acoustic transducer 10 comprises an outer housing 12 consisting of an inner cylindrical section 14 having a closed end 16 and an open end 18. A circular plate 20 having a central opening 22 is connected as by welding to the cylindrical section 14 at the open end 18 and has an outwardly extending cylindrical flange 24.

The cylindrical section 14 houses an electrical vibration transducer 26. The vibration transducer 26 includes a transformer 28 electrically connected to a crystal assembly 30 which converts electrical energy to vibrational energy, and vice versa. The crystal assembly 30 comprises three annular copper disks 32, 34 and 36 sandwiching annular piezoelectric disks 38 and 40. Particularly, the first piezoelectric disk 38 is between the first copper disk 32 and the second copper disk 34. The second piezoelectric 40 disk is between the second copper disk 34 and the third copper disk 36. This crystal assembly is initially held together using epoxy between engaged surfaces of the respective copper disks 32, 34 and 36 and the piezoelectric disks 38 and 40. The diameter of the copper disks 32, 34 and 36 is slightly larger than the diameter of the piezoelectric disks 38 and 40.

A steel annular disk 42, defining an inner inertial mass, receives a cylindrical insulator 44, through which extends a bolt 46. The bolt 46 has a head 48 larger than the opening of either the insulator 44 or steel disk 42. The bolt 46 further extends through central opening of each of the copper disks 32, 34 and 36 and the piezoelectric disks 38 and 40. Epoxy is used to further secure the steel disk 42 to third copper disk 36. The bolt is then threaded into an opening in a cylindrical steel member 52, defining an outer inertial mass, having a T-shaped cross-section, as shown. Epoxy is used to further fasten the head of the T-shaped steel member 52 to the first copper disk 32.

Figure 4:
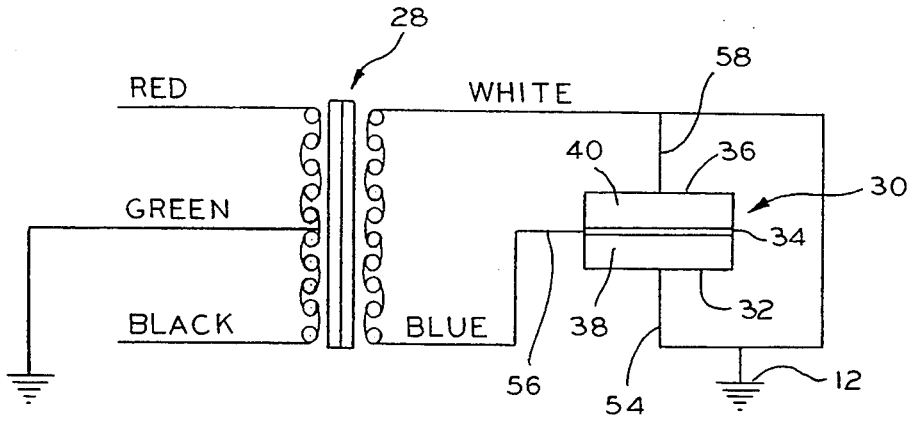
FIG. 4 is an electrical schematic of the transducer of FIG. 1.

The edges of the copper disks 32, 34 and 36 are bent over so that the copper is flat along the perimeter areas of the crystal assembly 30. The edge of the first copper disk 32 is bent over the outer inertial mass 52. The edge of the second copper disk 34 is bent over one of the piezoelectric disks 38 or 40. The edge of the third copper disk 36 is bent over the inner inertial mass 42. Respective wires 54, 56 and 58, see FIG. 4, are electrically connected, as by soldering, one each to the copper disks 32, 34 and 36. The crystal assembly 30 is then completely surrounded by a layer of cork 60, as shown.

A cylinder of cork 62, having a bottom wall 64, is secured in the housing inner cylindrical section 14 at the closed end 16. The transformer 28 is positioned in the housing 12 adjacent an opening 66 through the cork cylinder bottom wall 64 and the housing end wall 16. Particularly, electrical conductors (not shown) pass through the opening 66, which is then sealed using epoxy. The crystal sub-assembly 30 is centered in the housing cylindrical section 14 so that a top surface 68 of the outer inertial mass 52 extends above the cork layer 60 by 0.10 inches. Although not shown, the conductors 58 and 54 are electrically connected to the housing 12 using a conductive epoxy. The transducer case is then filled with a body 70 of epoxy so that the crystal assembly 30 and the transformer 28 are rigidly held in place. Particularly, a hard epoxy is used up to the head of the T-shaped outer inertial mass 52, as shown. The remainder of the housing cylindrical section 14 is filled with a body 72 of softer epoxy up to the edge of the plate circular opening 22, as shown.

Figure 2:
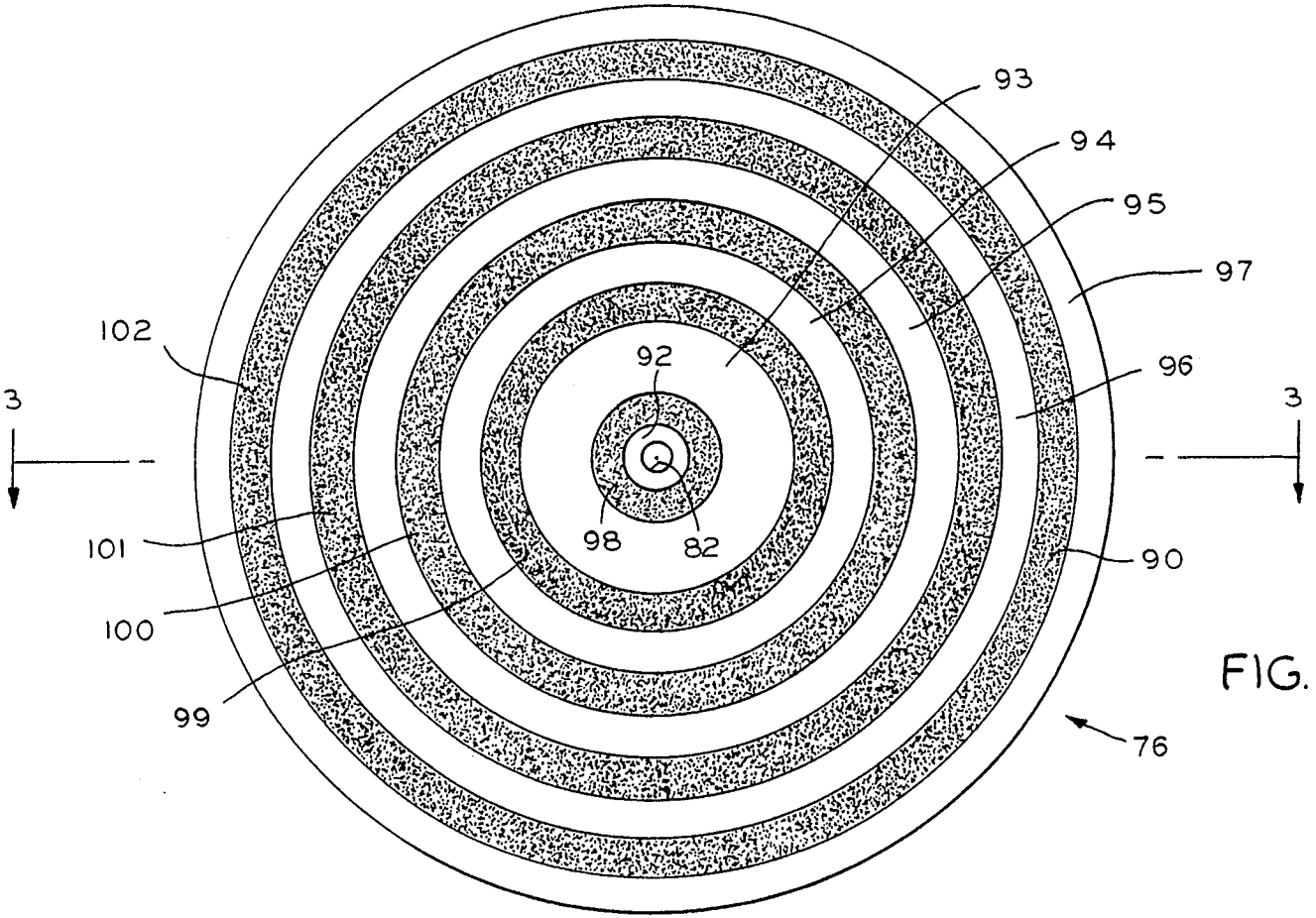
FIG. 2 is a plan view of a flexible oscillating assembly of the transducer of FIG. 1, the impedance matching layer being removed for clarity.
Figure 3:
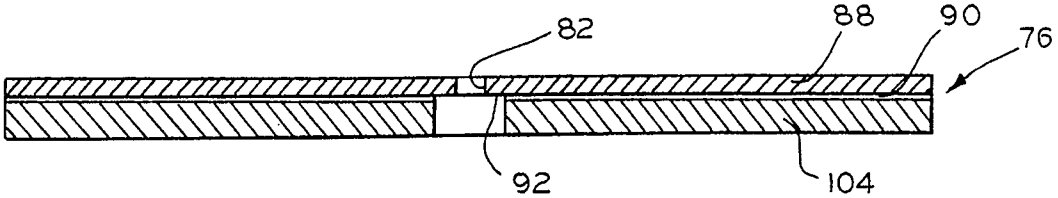
FIG. 3 is a sectional view taken along the line 3—3 of FIG. 2, and including the impedance matching layer.

A rubber O-ring 74 is secured as with epoxy to the circular plate 20 radially inwardly of the cylindrical flange 24. The O-ring 74 supports the outer perimeter of a flexible, circular oscillating assembly 76. The oscillating assembly 76 is held in place as with a bolt 80 passing through a central opening 82 and being received in an opening 82 in the stem of the outer inertial mass 52. Additionally, an epoxy seal 86 is used about the perimeter of the oscillating assembly 76 to seal it to the circular flange 24. With reference to FIGS. 2 and 3, the flexible oscillating assembly 76 comprises a flexible aluminum disk or plate 88. In the illustrated embodiment, the disk 88 has an outer diameter of 9.43 inches and a thickness of 0.051 inches. The center opening 82 has a diameter of 0.252 inches.

When the crystal assembly 30 is driven by the transformer 28, expansion and contraction of the piezoelectric material causes vibration transmitted through the top inertial mass 52 and bolt 80 to the flexible oscillating assembly 76, particularly the disk 88. The disk 88 is oscillated so that different concentric areas of the disk 88 do not vibrate. These areas are referred to as nodes. The nodes separate adjacent annular areas which oscillate oppositely and are referred to as positive anti-nodes and negative anti-nodes. Particularly, the vibrations in the negative anti-node areas are 180° out of phase with the vibrations in the positive anti-node areas. Normally, this would result in cancellation of sound waves as the sound wave moves a greater distance from the disk 88. In accordance with the invention, the flexible oscillating assembly 76 includes structure to minimize such cancellation as well as providing increased sensitivity, as discussed immediately below.

Advantageously, the crystal assembly 30 is driven with a short burst of a sine wave at the resonant frequency of the disk 88 to produce ten nodal circles. This transfers more energy to the disk 88 than with a single pulse.

A layer of adhesive 90 is adhered to an outer surface 92 of the disk 88. Concentric annular rings 93–97 of a barrier material are secured to the adhesive 90. Particularly, the rings 93–97 are successively larger. The sizes of the rings 93–97 are selected so that each covers one of the negative anti-node areas. The uncovered, thus exposed, areas therebetween are the positive anti-node areas (i.e., 180 degrees out of phase relative to the negative anti-node areas), represented by the respective exposed areas 98–102. In the illustrated embodiment of the invention, the size of the barrier rings 93–97 is as follows:

| RING # | INNER RADIUS | OUTER RADIUS |
|---|---|---|
| 93 | 9.2 mm | 21.1 mm |
| 94 | 33.1 mm | 45.1 mm |
| 95 | 57.1 mm | 69.1 mm |
| 96 | 81.1 mm | 93.1 mm |
| 97 | 105.1 mm | 116.1 mm |

The values for the above table were derived from the following equations. The size of the barrier tings is calculated by computing the location of the nodal circles. The theory of transverse (i.e., flexural) vibration of a circular plate is given in J. W. S. Rayleigh, *Theory of Sound,* paragraphs 218 and 219. For a disk with a free edge, the location of the nodal circles and the resonant frequency is obtained by solving the following equations:

$$ka\frac{J_0(ka)}{J_1(ka)} + \frac{I_0(ka)}{I_1(ka)} = 2(1-\mu) \quad (1)$$

$$J_0(kr) - \frac{J_1(ka)}{I_1(ka)} I_0(kr) = 0 \quad (2)$$

where k is a parameter called the wavenumber, a is the radius of the plate, r is the radius of the nodal circle, and $\mu$ is Poisson's ratio. $J_0$, $J_1$ are Bessel functions of order 0 and 1. $I_0$, $I_1$ are Hyperbolic Bessel functions of order 0 and 1.

Equation (1) has many solutions $k_i$, where the mode index i is any integer and corresponds to the number of nodal circles. The vibration with i nodal circles is called mode number i. Equation (1) gives values of ka, which when entered into Equation (2) gives values of r/a (since kr in Equation (2) an be written as (ka)(r/a)). r/a is the radius of a nodal circle expressed as a fraction of the outer radius of the disk.

This shows that these radii depend solely on the geometry of the plate and on one material property, namely Poisson's ratio, which has a small range of variation and is normally taken to be 0.25.

Figure 5:
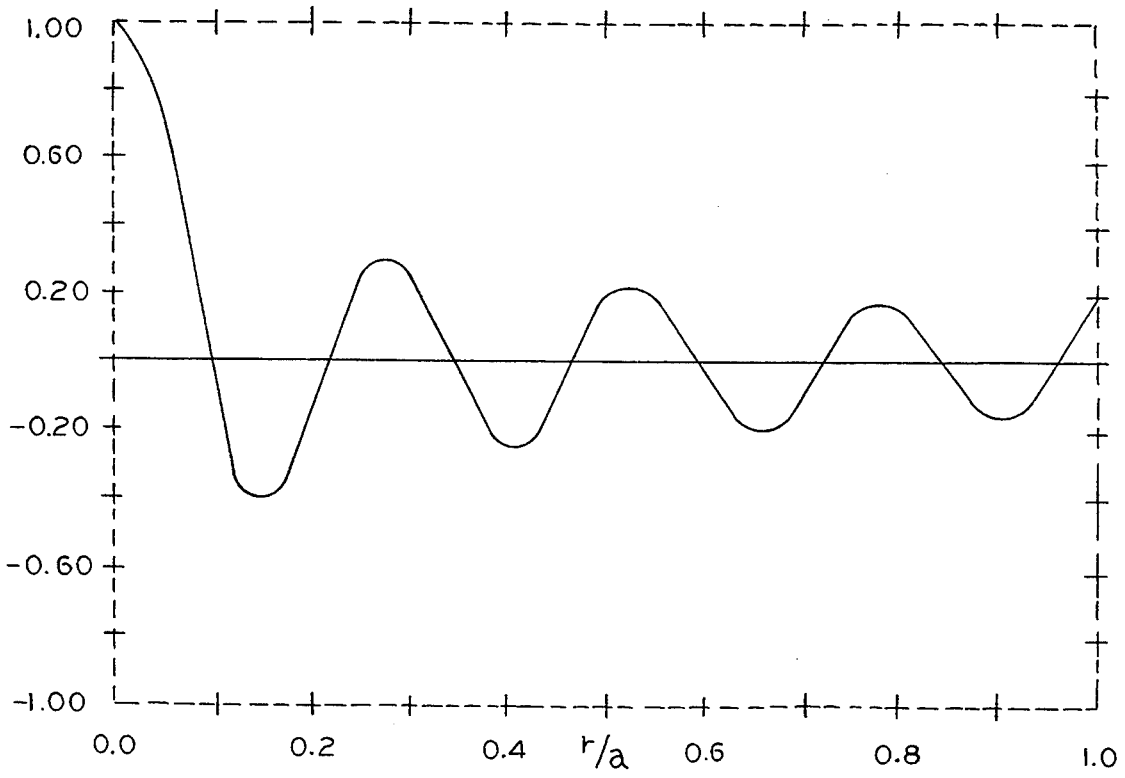
FIG. 5 is a curve illustrating mode shape for the use of ten nodal circles in the transducer of FIG. 1.

The resonant frequency of a particular mode is given by the equation:

$$f_i = (k_i a)^2 \frac{t}{\pi D^2} \frac{E}{3\rho(1-\mu^2)} \quad (3)$$

where $k_1$ a is the product of the wavenumber and plate radius obtained from equation (1). (k and a appear only as the product ka). t is the thickness of the plate, D is its diameter, E is the modulus of elasticity, $\rho$ is the density, and $\mu$ is Poisson's ratio. Once $K_i$ is determined from Equation (1), it can be entered into the equation:

$$w_i = J_o(kr) - J_i(k_i a/(I_1(k_1 a)) \times I_O(kr) \quad (4)$$

which gives the relative amplitude of vibration for any relative value of radius r/a. This is called the mode shape and is shown in FIG. 5 for i=10.

The above structure is shown in plan view in FIG. 2. To provide increased sensitivity, a circular layer 104 of impedance matching material is positioned in overlying relationship with the disk 88 outwardly of the rings 93–97 and adhesive layer 90. The impedance matching layer 104 comprises a body of polyethylene bun approximately 0.15 inches thick. Owing to the minimal thickness of the rings 93–97, the matching layer is secured to the disk 88 via the adhesive layer 90, particularly at the exposed areas 98–102.

The barrier rings 93–97 can be applied in one of two ways. One alternative is to provide pre-cut plastic rings of polyester film, which are then adhered directly to the adhesive 90. Alternatively, a backing paper can be included on an adhesive tape, with the backing layer being scored in concentric circles corresponding to the inner and outer diameters of the barrier rings 93–97, discussed above. The backing layer in the areas 98–102 to be exposed are removed, with the barrier rings 93–97 remaining.

As described above, the adhesive layer 90 provides a positive securement between the flexible disk 88 and the impedance matching layer 104 in the positive anti-node areas. The plastic rings 93–97 prevent securement in the negative anti-node areas. This lack of bonds in the negative anti-node areas provides poor matching so that a greater acoustic efficiency results in the positive anti-node areas than in the negative anti-nodal areas to minimize cancellation of sound waves. Moreover, the plastic rings 93–97 act as a barrier in the negative anti-node areas as by a absorbing and/or blocking sound waves to further minimize cancellation. Additionally, the use of the impedance matching layer 104 being bonded in the positive anti-node areas increases the efficiency of transmission of vibrational energy between the disk 88 and surrounding media and vice versa.

With reference to FIG. 4, an electrical schematic shows external connections being provided to the transformer 28. Particularly, a center tap to the transformer 28 is grounded while additional conductors, labeled red and black, are used for connection to an external control circuit. These connections are provided for both generating pulses and receiving return echo pulses, as is well known.

In accordance with the invention, the acoustic transducer 10 provides several advantages. These advantages include that it is simple and inexpensive to construct due to use of a constant thickness impedance matching material. Moreover, it has improved accuracy and directionality. In addition, its characteristics will not change when used in bad environments owing to the use of the uniform matching surface. Finally, the impedance matching section increases efficiency of ultrasonic transmission from the disk 88 to air, which improves sensitivity.

The illustrated embodiment of the invention is intended to illustrate the broad concepts comprehended.

I claim:

1. An acoustic transducer comprising:

an electrical vibration transducer; and a flexible oscillating assembly operatively connected to said vibration transducer for radiating sound waves between surrounding media and said vibration transducer, said assembly comprising a flexible plate to define a plurality of concentric, radially spaced annular anti-nodes, such that adjacent anti-nodes vibrate oppositely, a layer of adhesive on an outer surface of said plate, a plurality of concentric, annular barrier rings secured to said plate at alternate anti-nodes to define exposed areas therebetween, and a layer of acoustic impedance matching material overlying said plate outwardly of said barrier rings and secured to said plate at said exposed areas, so that said barrier rings prevent cancellation of acoustic waves and said impedance matching material increases sensitivity of said acoustic transducer.

2. The acoustic transducer of claim 1 vibration transducer comprises a piezoelectric transducer.

3. The acoustic transducer of claim 1 wherein said oscillating assembly is secured to the vibration transducer using a threaded fastener.

4. The acoustic transducer of claim 1 wherein said layer of impedance matching material is of uniform thickness.

5. The acoustic transducer of claim 1 wherein said barrier rings comprise plastic rings.

6. The acoustic transducer of claim 1 wherein said barrier rings comprise polyester film rings.

7. An acoustic transducer comprising:

an electrical vibration transducer; and a flexible, circular oscillating assembly operatively connected to said vibration transducer about an axial centerpoint thereof for radiating sound waves between surrounding media and said vibration transducer, said assembly comprising a flexible, circular plate to define a plurality of concentric, radially spaced anti-nodes, such that adjacent anti-nodes vibrate oppositely, a layer of adhesive on an outer surface of said plate, a plurality of concentric, annular, successively larger barrier rings secured to said plate at alternate anti-nodes to define exposed anti-nodes therebetween, and a layer of acoustic impedance matching material overlying said plate outwardly of said barrier rings and secured to said plate at said exposed anti-nodes, so that said barrier rings prevent cancellation of acoustic waves and said impedance matching material increases sensitivity of said acoustic transducer.

8. The acoustic transducer of claim 7 vibration transducer comprises a piezoelectric transducer.

9. The acoustic transducer of claim 7 wherein said oscillating assembly is secured to the vibration transducer using a threaded fastener.

10. The acoustic transducer of claim 7 wherein said layer of impedance matching material is of uniform thickness.

11. The acoustic transducer of claim 7 wherein said barrier rings comprise plastic rings.

12. The acoustic transducer of claim 7 wherein said barrier rings comprise polyester film rings.

13. An acoustic transducer comprising:

an electrical vibration transducer; and a flexible oscillating assembly operatively connected to said vibration transducer for radiating sound waves between surrounding media and said vibration transducer, said assembly comprising a flexible plate to define a plurality of concentric, radially spaced annular anti-nodes, such that adjacent anti-nodes vibrate oppositely, a plurality of concentric, annular rings of exposed adhesive on an outer surface of said plate at alternate anti-nodes, and a layer of acoustic impedance matching material overlying said plate and secured to said plate at said exposed adhesive rings to prevent cancellation of acoustic waves and said impedance matching material increases sensitivity of aid acoustic transducer.

14. The acoustic transducer of claim 13 wherein the vibration transducer comprises a piezoelectric transducer.

15. The acoustic transducer of claim 13 wherein said oscillating assembly is secured to the vibration transducer using a threaded fastener.

16. The acoustic transducer of claim 13 wherein said layer of impedance matching material is of uniform thickness.

17. The acoustic transducer of claim 13 further comprising barrier rings secured to said plate at the areas between said adhesive rings.

18. The acoustic transducer of claim 17 wherein said barrier rings comprise polyester film rings.

* * * * *